US007728809B2

(12) United States Patent
Lewis

(10) Patent No.: US 7,728,809 B2
(45) Date of Patent: Jun. 1, 2010

(54) METHOD, APPARATUS AND COMPUTER PROGRAM PRODUCT FOR CONTROLLING LED BACKLIGHTS AND FOR IMPROVED PULSE WIDTH MODULATION RESOLUTION

(75) Inventor: Roger Lewis, Kansas City, MO (US)

(73) Assignee: Honeywell International Inc., Morristown, NJ (US)

( * ) Notice: Subject to any disclaimer, the term of this patent is extended or adjusted under 35 U.S.C. 154(b) by 623 days.

(21) Appl. No.: 11/633,257

(22) Filed: Dec. 4, 2006

(65) Prior Publication Data

US 2007/0115304 A1 May 24, 2007

Related U.S. Application Data

(62) Division of application No. 09/834,276, filed on Apr. 12, 2001, now Pat. No. 7,176,948.

(60) Provisional application No. 60/196,770, filed on Apr. 12, 2000.

(51) Int. Cl.
*G09G 3/36* (2006.01)

(52) U.S. Cl. ..... 345/102; 345/84; 345/87; 345/691

(58) Field of Classification Search ..... 345/39, 345/44, 46–48, 52–54, 77–78, 82–84, 87–88, 345/94–96, 102, 691–692; 318/811; 327/175, 327/172; 315/169.3, 312, 291, 362
See application file for complete search history.

(56) References Cited

U.S. PATENT DOCUMENTS 5,023,535 A 6/1991 Miller et al. ..... 318/599
5,248,900 A 9/1993 Davis ..... 307/265
5,440,208 A 8/1995 Uskali et al.
5,577,235 A 11/1996 Mitra ..... 395/559

(Continued)

FOREIGN PATENT DOCUMENTS

JP 04-096417 3/1992

(Continued)

OTHER PUBLICATIONS

Lewis, R.; USPTO Office Action dated Dec. 18, 2009, U.S. Appl. No. 11/621,467.

*Primary Examiner*—Richard Hjerpe
*Assistant Examiner*—Mansour M Said
(74) *Attorney, Agent, or Firm*—Ingrassia Fisher & Lorenz, P.C.

(57) ABSTRACT

A method for driving an LED backlight device using pulse width modulation with an additional timer to manage the power consumption, thermal output, and lighting level of the device with improved resolution. The method includes receiving a commanded brightness level, and using an n bit pulse width modulator that has a nominal time period ($P_n$) to assert a plurality of pulses in accordance with an output of the n bit pulse modulator. A modulator output value is assigned to each one of K states of a K state timer that has a timer period ($P_T$). The plurality of pulses is output according to the modulator output value during each nominal time period occurring within the timer period. Power to the display is supplied in accordance with the plurality of pulses.

9 Claims, 9 Drawing Sheets

U.S. PATENT DOCUMENTS

| | | | | |
|---|---|---|---|---|
| 5,589,805 | A * | 12/1996 | Zuraski et al. | 332/109 |
| 5,803,579 | A | 9/1998 | Turnbull et al. | 362/83.1 |
| 5,889,424 | A | 3/1999 | Iwata et al. | 327/355 |
| 5,912,568 | A | 6/1999 | Kiley | 327/108 |
| 6,016,326 | A | 1/2000 | Claisse et al. | 372/44 |
| 6,049,703 | A | 4/2000 | Staudinger et al. | 455/114 |
| 6,061,218 | A | 5/2000 | Ida et al. | 361/56 |
| 6,087,969 | A | 7/2000 | Stockstad et al. | 341/143 |
| 6,138,047 | A | 10/2000 | Proffitt et al. | 700/14 |
| 6,182,235 | B1 | 1/2001 | Ma et al. | 713/501 |
| 6,191,868 | B1 | 2/2001 | Shibuya et al. | 358/1.9 |
| 6,232,963 | B1 * | 5/2001 | Tew et al. | 345/204 |
| 6,239,716 | B1 | 5/2001 | Pross et al. | 340/815.4 |
| 6,342,997 | B1 | 1/2002 | Khadkikar et al. | |
| 6,362,578 | B1 | 3/2002 | Swanson et al. | 315/307 |
| 6,396,486 | B1 | 5/2002 | Kuo et al. | 345/326 |
| 6,445,790 | B1 | 9/2002 | Burgan et al. | 379/361 |
| 6,636,003 | B2 | 10/2003 | Rahm et al. | 315/179 |
| 6,727,765 | B1 | 4/2004 | Ess | 331/78 |
| 6,995,518 | B2 | 2/2006 | Havlik et al. | 315/169.3 |
| 7,187,705 | B1 | 3/2007 | Richmond | 375/130 |
| 7,230,971 | B1 | 6/2007 | Beard | 375/132 |
| 2002/0030455 | A1 | 3/2002 | Ghanem | |
| 2003/0222587 | A1 | 12/2003 | Dowling, Jr. et al. | |

FOREIGN PATENT DOCUMENTS

| | | |
|---|---|---|
| WO | WO 01/27910 | 4/2001 |

* cited by examiner

*Fig. 2*

| NUMBER OF UNIT PULSE LENGTHS | MODULATOR BINARY OUTPUT COMBINATIONS | TIMER STATE | EFFECTIVE DUTY CYCLE |
|---|---|---|---|
| 0 | 0 0<br>0 0 | 0<br>1 | = 0% (0/8) |
| | 0 0<br>0 0 | 0<br>1 | |
| 1 | 0 0<br>0 1 | 0<br>1 | = 12.5% (1/8) |
| | 0 1<br>0 0 | 0<br>1 | |
| 2 | 0 1<br>0 1 | 0<br>1 | = 25% (2/8 = 1/4) |
| | 0 1<br>0 1 | 0<br>1 | |
| | 0 0<br>1 0 | 0<br>1 | |
| | 1 0<br>0 0 | 0<br>1 | |
| 3 | 0 0<br>1 1 | 0<br>1 | = 37.5% (3/8) |
| | 1 1<br>0 0 | 0<br>1 | |
| | 0 1<br>1 0 | 0<br>1 | |
| | 1 0<br>0 1 | 0<br>1 | |
| 4 | 0 1<br>1 1 | 0<br>1 | = 50% (4/8 = 1/2) |
| | 1 1<br>0 1 | 0<br>1 | |
| | 1 0<br>1 0 | 0<br>1 | |
| | 1 0<br>1 0 | 0<br>1 | |
| 5 | 1 0<br>1 1 | 0<br>1 | = 62.5% (5/8) |
| | 1 1<br>1 0 | 0<br>1 | |
| 6 | 1 1<br>1 1 | 0<br>1 | = 75% (6/8 = 3/4) |
| | 1 1<br>1 1 | 0<br>1 | |

| DUTY CYCLE | POSSIBLE MODULATOR BINARY OUTPUT COMBINATIONS | TIMER STATE |
|---|---|---|
| 0% (0/8) | 0 0 | 0 |
| | 0 0 | 1 |
| 12.5% (1/8) | 0 1 | 0 |
| | 0 0 | 1 |
| | 0 0 | 0 |
| | 0 1 | 1 |
| 25% (2/8) | 0 0 | 0 |
| | 1 0 | 1 |
| | 1 0 | 0 |
| | 0 0 | 1 |
| | 0 1 | 0 |
| | 0 1 | 1 |
| 37.5% (3/8) | 0 0 | 0 |
| | 1 1 | 1 |
| | 1 1 | 0 |
| | 0 0 | 1 |
| | 0 1 | 0 |
| | 1 0 | 1 |
| | 1 0 | 0 |
| | 0 1 | 1 |
| 50% (4/8) | 0 0 | 0 |
| | 1* 00 | 1 |
| | 1* 00 | 0 |
| | 0 0 | 1 |
| | 0 1 | 0 |
| | 1 1 | 1 |
| | 1 1 | 0 |
| | 0 1 | 1 |
| | 1 0 | 0 |
| | 1 0 | 1 |
| 62.5% (5/8) | 0 1 | 0 |
| | 1* 00 | 1 |
| | 1* 00 | 0 |
| | 0 1 | 1 |
| | 1 1 | 0 |
| | 1 0 | 1 |
| | 1 0 | 0 |
| | 1 1 | 1 |
| 75% (6/8) | 1* 00 | 0 |
| | 1 0 | 1 |
| | 1 0 | 0 |
| | 1* 00 | 1 |
| | 1 1 | 0 |
| | 1 1 | 1 |
| 87.5% (7/8) | 1* 00 | 0 |
| | 1 1 | 1 |
| | 1 1 | 0 |
| | 1* 00 | 1 |
| 100% (8/8) | 1* 00 | 0 |
| | 1* 00 | 1 |

* INDICATES OVERFLOW BIT

Fig. 4

| TOTAL PULSE DURATION AS MEASURED IN UNIT PULSE LENGTHS | MODULATOR OUTPUT IN EACH TIMER STATE | | | | | | | |
|---|---|---|---|---|---|---|---|---|
| | TIMER STATE | | | | | | | |
| | 1 | 2 | 3 | 4 | 5 | 6 | 7 | 8 |
| 0 | 0 | 0 | 0 | 0 | 0 | 0 | 0 | 0 |
| 1 | 1 | 0 | 0 | 0 | 0 | 0 | 0 | 0 |
| 2 | 1 | 0 | 0 | 0 | 1 | 0 | 0 | 0 |
| 3 | 1 | 0 | 1 | 0 | 1 | 0 | 0 | 0 |
| 4 | 1 | 0 | 1 | 0 | 1 | 0 | 1 | 0 |
| 5 | 1 | 1 | 1 | 0 | 1 | 0 | 1 | 0 |
| 6 | 1 | 1 | 1 | 0 | 1 | 1 | 1 | 0 |
| 7 | 1 | 1 | 1 | 1 | 1 | 1 | 1 | 0 |
| 8 | 1 | 1 | 1 | 1 | 1 | 1 | 1 | 1 |
| 9 | 2 | 1 | 1 | 1 | 1 | 1 | 1 | 1 |
| 10 | 2 | 1 | 1 | 1 | 2 | 1 | 1 | 1 |
| 11 | 2 | 1 | 2 | 1 | 2 | 1 | 1 | 1 |
| 12 | 2 | 1 | 2 | 1 | 2 | 1 | 2 | 1 |
| 13 | 2 | 2 | 2 | 1 | 2 | 1 | 2 | 1 |
| 14 | 2 | 2 | 2 | 1 | 2 | 2 | 2 | 1 |
| 15 | 2 | 2 | 2 | 2 | 2 | 2 | 2 | 1 |
| 16 | 2 | 2 | 2 | 2 | 2 | 2 | 2 | 2 |
| 17 | 3 | 2 | 2 | 2 | 2 | 2 | 2 | 2 |
| 18 | 3 | 2 | 2 | 2 | 3 | 2 | 2 | 2 |
| 19 | 3 | 2 | 3 | 2 | 3 | 2 | 2 | 2 |
| 20 | 3 | 2 | 3 | 2 | 3 | 2 | 3 | 2 |
| 21 | 3 | 3 | 3 | 2 | 3 | 2 | 3 | 2 |
| 22 | 3 | 3 | 3 | 2 | 3 | 3 | 3 | 2 |
| 23 | 3 | 3 | 3 | 3 | 3 | 3 | 3 | 2 |
| 24 | 3 | 3 | 3 | 3 | 3 | 3 | 3 | 3 |
| ⋮ | ⋮ | ⋮ | ⋮ | ⋮ | ⋮ | ⋮ | ⋮ | ⋮ |
| 2040 | 255 | 255 | 255 | 255 | 255 | 255 | 255 | 255 |
| ⋮ | ⋮ | ⋮ | ⋮ | ⋮ | ⋮ | ⋮ | ⋮ | ⋮ |
| 2047 | 256 | 256 | 256 | 256 | 256 | 256 | 256 | 256 |

*Fig. 9*

METHOD, APPARATUS AND COMPUTER PROGRAM PRODUCT FOR CONTROLLING LED BACKLIGHTS AND FOR IMPROVED PULSE WIDTH MODULATION RESOLUTION

CROSS-REFERENCES TO RELATED APPLICATIONS

This application is a divisional of, claims priority to, and incorporates by reference the disclosure of U.S. patent application Ser. No. 09/834,276 filed Apr. 12, 2001, now U.S. Pat. No. 7,176,948, which claims priority to, and incorporates by reference the disclosure of U.S. application Ser. No. 60/196,770 entitled: "Apparatus and Method of Extending Pulse Width Modulation Resolution," filed Apr. 12, 2000, the entire text of which is incorporated by reference.

BACKGROUND OF THE INVENTION

The present invention relates generally to control of light emitting diode (LED) devices and in particular to control of LED backlights using pulse width modulation.

A light emitting diode, or LED, comprises a diode that emits visible light when current passes through it. LEDs have several applications. Certain display devices, for example, but not limited to, aircraft cockpit displays, use an array of LEDs to backlight and illuminate a liquid crystal display (LCD). Controlling the amount of light emitted by the LED array is desirable to adjust the brightness of the display. The brightness level impacts the ease with which the display may be viewed under certain lighting conditions, such as bright sunlight or dark environment; and individual viewer comfort level with the display.

In some applications, the brightness level is more than a convenience factor. For example, in the aviation environment, if the display is illuminated too brightly at night, the excessive brightness may adversely impact the pilot's night vision. Impaired night vision adversely impacts the safety of flight.

The brightness level additionally impacts the amount of power required to operate the device as well as the heat given off by the display. Power consumption affects the length of time the device can operate on battery power and the electrical load placed on the vehicle power supply systems. The heat given off by the display also affects what, if any, cooling of the display and surrounding equipment is required. Cooling devices add cost and complexity to equipment and systems. In aircraft/spacecraft applications, cooling systems add unwanted additional weight to the vehicle. Furthermore, if the display generates too much heat, touching or otherwise operating the display may cause discomfort to the user.

The amount of light emitted by the diode can be controlled by controlling the amount of power supplied to the diode where power equals voltage times current (P=V*I). In certain prior art devices, a microprocessor device is coupled to drive circuitry that controls the LED display brightness. In such designs, a technique known as pulse width modulation (PWM) is used to control the power supplied to the device. Under control of the microprocessor, the drive circuitry supplies current to the LED for a predetermined amount of time, or one pulse width. In this manner, by varying the number of pulses received and the width of the pulses, the total power supplied to the LED, and hence the brightness can be controlled.

One significant limitation on this prior art design is that the pulse frequency and duration are limited by the resolution with which the pulse frequency and width can be defined by the microprocessor. For this reason, it is not always possible to control the LED display with the specificity and precision desired. This fact may result in the LED display being too bright at one setting, but too dark at the next available setting. In an aviation environment, this fact can cause the cockpit display to be illuminated too brightly at night even on the lowest available setting.

Correction of the above deficiencies cannot presently be accomplished without a complete redesign of the microprocessor/driver hardware. Redesign is frequently impractical because often, the pulse width modulation output of the microprocessor is part of a predefined set of operations purchased with the selected microprocessor chip; and its resolution is limited by the number of bits the microprocessor can output. Redesign of standard LED drive circuit hardware is also undesirable due to the cost of custom designing and fabricating such circuits.

BRIEF SUMMARY OF THE INVENTION

The present invention provides a method and computer program product useful for controlling the power supplied to an LED. The present invention improves the resolution with which the brightness of LED backlit displays may be controlled. The present invention also contributes to minimizing the heat energy dissipated by the display device.

According to one aspect of the present invention, the invention may be used to improve the resolution of existing pulse width modulation systems without the need for hardware redesign.

According to another aspect of the present invention, the invention includes an additional timing source that enables the pulse duration of the pulse width modulation pulses to be varied with greater precision. A number of states are associated with the additional timing source. For each of the timer states, the resolution of the modulator is improved by $\log_2 K$, where K=the number of timer states.

BRIEF DESCRIPTION OF THE DRAWINGS

FIG. 2 is a truth table for improved resolution pulse width modulation using a two bit modulator with additional timer state according to a preferred embodiment of the present invention;

FIG. 4 is a truth table of modulator output with overflow bit vs. timer state for desired duty cycle according to a preferred embodiment of the present invention;

FIG. 9 illustrates the output according to the flow chart of FIG. 8 for a virtual 11 bit modulator using an 8 bit modulator and 8 timer states.

DETAILED DESCRIPTION OF THE PREFERRED EMBODIMENTS

Figure 1A:
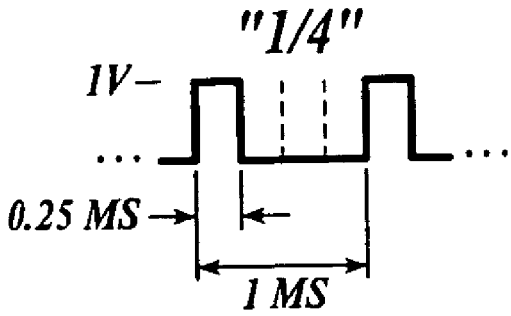
FIG. 1A is a diagram of a ¼ duty cycle pulse width modulation scheme using a two bit resolution pulse width modulator.
Figure 1B:
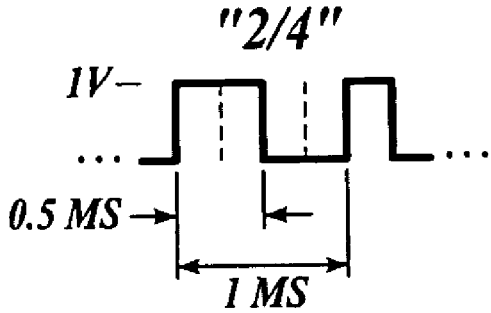
FIG. 1B is a diagram of a ½ duty cycle pulse width modulation scheme using a two bit resolution pulse width modulator.
Figure 1C:
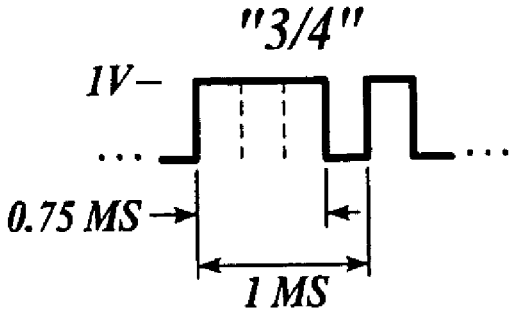
FIG. 1C is a diagram of a ¾ duty cycle pulse width modulation scheme using a two bit resolution pulse width modulator.

FIGS. 1A-1C contain illustrations of how pulse width modulation can be used to control power to a load such as, for example, an LED or array of LEDs. The PWM duty cycle is the ratio of the amount of time the pulse is on, to the interval of time in which the pulse is off. In the example of FIG. 1A, a pulse 2 is on during the interval from t=0 seconds to t=0.25 milliseconds (ms). No pulse occurs for the interval from t=0.25 ms to t=1 ms for a total of 0.75 ms. The duty cycle in the example of FIG. 1A is therefore ¼. The duty cycle in the example of FIG. 1B is ½, and the duty cycle of FIG. 1C is ¾.

If the magnitude of the pulse of FIGS. 1A-1C is 1 Volt, then the average voltage supplied to the LED in a 1 ms interval is 0.25V for FIG. 1A, 0.5V for FIG. 1B, and 0.75V in FIG. 1C. Thus, through operation of the pulse width modulation schemes of FIGS. 1A-1C, the total power supplied to the LED, and hence its brightness and thermal output can be controlled.

However, the power output mandated by the pulse width modulation scheme is limited by the resolution of the pulse width modulator. For example, if a pulse width modulator has n bits of resolution, the pulse width modulator can vary its output from 0 to $2^n-1$; and change its duty cycle in 1/(2"n) step intervals. In the example of FIGS. 1A-1C, a pulse width modulator having a resolution of two bits was used to create the duty cycles and power outputs shown. The two bit pulse width modulator of FIGS. 1A-1C therefore has the following possible binary outputs: 00, 01, 10, and 11. Since there are four possible output values, the pulse width modulator can only change its duty cycle in intervals of $1/(2^2)$ or ¼. Hence, the average power supplied can only be varied in ¼ V increments. Table I contains a truth table showing the output pulse as a function of modulator output for the two bit modulator used as an example throughout this document.

TABLE I

Duty Cycle For An Example Modulator Having Two Bits of Resolution PWM Period = 1 ms

| Modulator Binary Output | Output Pulse Duration (ms) | Duty Cycle |
|---|---|---|
| 00 | 0 | 0 |
| 01 | 0.25 | ¼ |
| 10 | 0.50 | ½ |
| 11 | 0.75 | ¾ |

Increasing the bit resolution of the pulse width modulator provides greater resolution in the duty cycle that can be specified. For example, the Motorola 68HC16Z1 is a common processor used to provide pulse width modulation outputs. This Motorola processor has a resolution of n=8 bits and can thus vary its output to have values corresponding to between 0 and 255. This processor can therefore increment the PWM duty cycle in steps 1/256.

Yet, even with an 8 bit processor, the resolution provided by the pulse width modulation scheme may not be adequate for the task at hand. Suppose, for purposes of illustration, that using the two bit pulse width modulator of FIGS. 1A-1C, an increment of ⅛ V was desired. This increment is not possible using the pulse width modulator of FIGS. 1A-1C, because the smallest increment that can be specified is ¼ V. Likewise, a duty cycle smaller than 1/256 cannot be specified using the 8 bit Motorola processor described above. Absent the present invention, the only way to achieve the desired resolution is to change the pulse width modulator to one having three bit or higher resolution. Changing the hardware in such fashion may be impractical because the desired hardware is unavailable or costly due to the associated hardware and software changes.

The present invention provides a method and computer program product for virtually increasing the resolution of a pulse width modulator having n bits. In a preferred embodiment of the invention, the invention includes an additional timer with a predetermined associated number of states. During each of the timer states, the pulse width modulator output has one of $2^n$ n possible values. Thus, according to the present invention, a number of virtual bits, m, equal to the base 2 log of the number of timer states, can be added to the n existing bits of resolution. The resulting pulse width modulation has n+m bits of resolution. A better understanding of the principals of the present invention can be had with reference to the derivation below. In general, the duty cycle can be expressed as the ratio of the pulse "on" time to the total period as given in equation (1).

$$\text{Duty Cycle}=\text{total pulse on time/total period} \quad \text{Eq. (1)}$$

For a fixed bit modulator having n bits of resolution and a nominal period, $P_n$, the shortest duration pulse has a length in seconds of:

$$\text{Unit Pulse Length}(s) = U = \frac{P_n}{2^n} \quad \text{Eq. (2)}$$

In the present invention, the total pulse on time in that state can be expressed as:

$$\text{ON TIME STATE } k = \frac{N_k U P_T}{P_n} \quad \text{Eq. (3)}$$

Where: $N_k$=number of unit pulse lengths specified in that state=output of modulator for state k; and $P_T$=the additional timer period in seconds The total pulse on time can be obtained by summing equation (3) for each state k=0 to k=K−1, where K equals the total number of states; e.g. $K=2^m$, where m=the numbered virtual bits of resolution added.

The total time period, T, in seconds, is given as:

$$T=P_T K \quad \text{Eq. (4)}$$

The duty cycle of the pulse width modulation according to the present invention can therefore be expressed as:

$$\text{Duty Cycle} = \frac{\sum_{k=0}^{k=K-1}\left(\frac{N_k UP_T}{P_n}\right)}{T} = \frac{\sum_{k=0}^{k=K-1}\left(\frac{N_k UP_T}{P_n}\right)}{P_T K} = \sum_{k=0}^{k=K-1}\frac{N_k U}{P_n K} \quad \text{Eq. (5)}$$

For the smallest possible duty cycle, only one single unit pulse will be specified and will occur in only one of the k states. By setting $N_k 1$=(where 1 is the smallest non-zero integer), equation 5 can thus be reduced to express the highest resolution duty cycle as:

$$\text{Minimum Duty Cycle} = \frac{U}{P_n K} \quad \text{Eq. (6)}$$

Substituting Eq. (2) into Eq. (6) and reducing the equation yields:

$$\text{Minimum Duty Cycle} = \frac{1}{2^n}\cdot\frac{1}{K} \quad \text{Eq. (7)}$$

Thus, the present invention permits additional bits of resolution to be added by adding states to the additional timer. For the example two bit processor of FIGS. 1A-1C and Table 1, additional virtual bits of resolution can be added as shown in Table II below.

TABLE II

Pulse Width Modulator Resolution as a Function of Number of Timer States

| No. of Timer States | No. of Bits of Virtual Resolution Added | Resulting Resolution For n = 2 Bit Modulator |
|---|---|---|
| 2 | 1 | $2^3$ |
| 4 | 2 | $2^4$ |
| 8 | 3 | $2^5$ |
| 16 | 4 | $2^6$ |

Figure 3A:
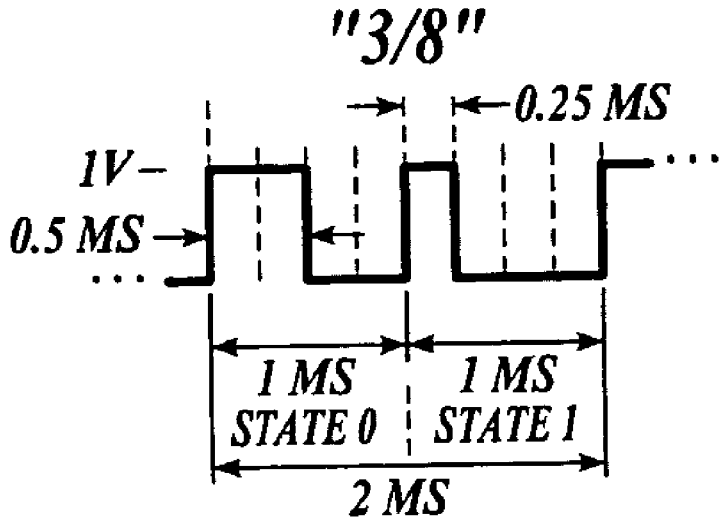
FIG. 3A is a diagram of a pulse width modulation scheme having improved resolution according to a preferred embodiment of the present invention.
Figure 3B:
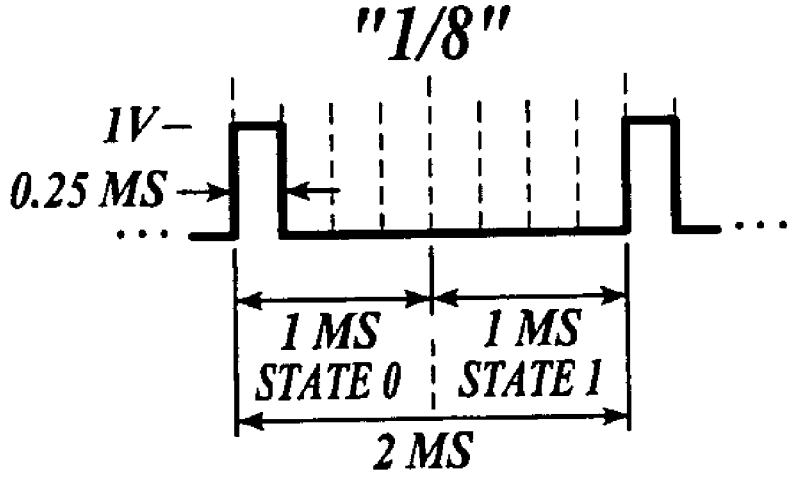
FIG. 3B is a diagram of a second pulse width modulation scheme having improved resolution according to a preferred embodiment of the present invention.

FIG. 2 and FIGS. 3A-3B illustrates how the resolution of the two bit pulse width modulator of FIGS. 1A-1C can be improved according to the present invention. The embodiment of FIG. 2, adds a single additional timer having the same period as the pulse width modulation period. In this example, that period equals ms and the total time period is therefore 2 ms. The timer has two states: 0 and 1 thereby providing $2^3$ bits of resolution. In timer state 0, the pulse width modulator output has a first value. In timer state 1, the modulator output has a second value for the duration of the timer state. The first value and the second value output by the pulse width modulator in each of the timer states can be equivalent if desired. The sum of the first and second values, however, equals the total number of unit pulse time intervals required to obtain the desired duty cycle.

FIG. 2 contains a truth table for creating the various duty cycles in $1/2^3$ increments. If a duty cycle of ⅜ is desired, the total number of unit pulse lengths occurring during the two timer states must equal 3. In the example truth table of FIG. 2, any one of four possible combinations of modulator output as a function of timer state may be implemented to obtain the desired three pulse units. For example, during timer state 0, the modulator output can be set to 00 and no pulse is output during the first 1 ms. During the second 1 ms period, the additional timer is in state 1 and the modulator output is binary 11, or decimal 3, and a pulse of three unit lengths are output during this time period. The total output during the two timer states is thus three pulse units yielding a duty cycle of ⅜. Optionally, a pulse of two pulse unit lengths, or 0.5 ms may be output in timer state 0 and one pulse of 0.025 ms may be output in timer state 1 to obtain the ⅜ duty cycle. FIG. 3A shows the corresponding waveform.

FIG. 3B shows a waveform for a ⅛ duty cycle constructed according to the example truth table of FIG. 2. In FIG. 3B, when the timer is in state 0, the pulse width modulator binary output is 01 and a single 0.25 ms pulse is output during the time period t=0 until t=1 ms. From the time period t=1 ms to t=2 ms the timer is in state 1 and no pulse is present during this interval. As shown in FIG. 2, the single pulse may optionally be set to occur in state 1, while no pulse is provided in state 0.

Some modulators allow for a 100% duty cycle through the use of an overflow bit. Thus, a bit modulator will have an overflow bit in the n+1 bit position, that when asserted, results in an output pulse having the length of the nominal modulator time period. Use of the overflow bit may be incorporated into the present invention. FIG. 4 illustrates how the example modulator of Table I can be used with an overflow bit to create a pulse width modulator having 3 bit resolution using an additional two state timer according to the present invention. As with the truth table of FIG. 2, various modulator output combinations are possible to obtain certain ones of the possible duty cycles.

As shown in each of the above examples, the total period of the pulse width modulator has been effectively increased from the 1 ms period of FIGS. 1A-1C to the 2 ms period of FIGS. 2 and 3A-B through the use of the additional timer. In the example of FIGS. 1A-1C, the update interval occurred every 1 ms, or 1000 Hz, whereas from the example of FIGS. 2 and 3A-B, the update interval is 2 ms, or 500 Hz. Thus, the additional resolution provided by the present invention impacts the update rate available. A lengthy update rate can cause perceptible flicker in the LCD display. However, so long as any required update rates can be maintained, additional "virtual bits" of resolution may be added according to the present invention.

Figure 5A:
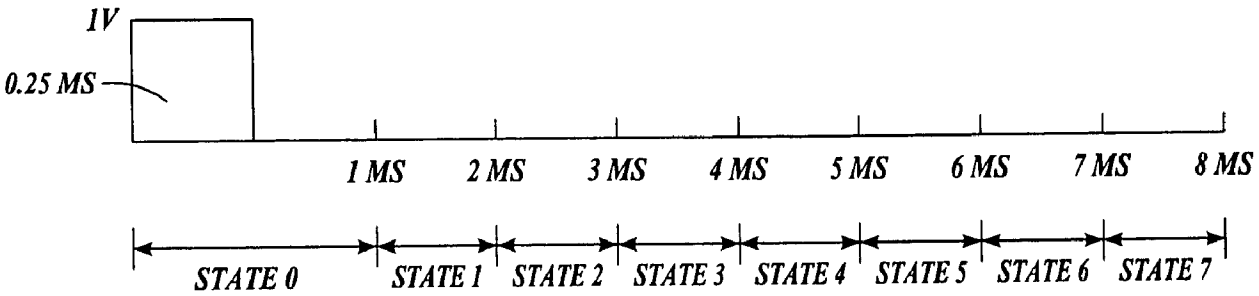
FIG. 5A is a diagram of a five bit virtual pulse width modulation scheme having an update rate of 125 Hz according to a preferred embodiment of the present invention.
Figure 5B:
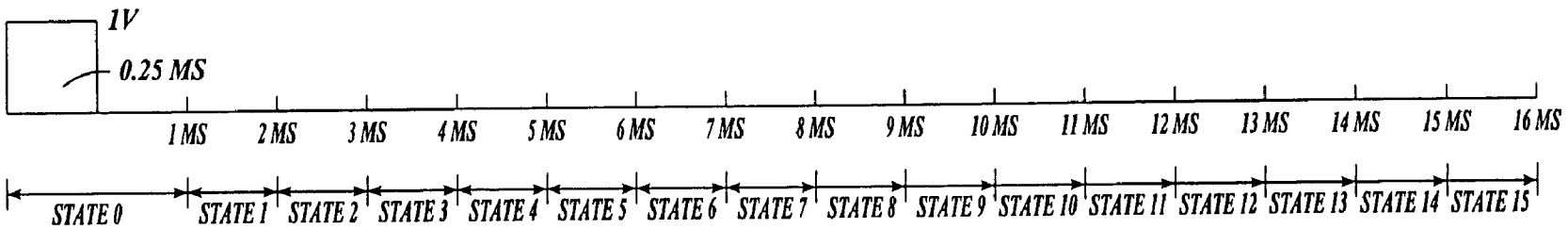
FIG. 5B is a diagram of a six bit virtual pulse width modulation scheme having an update rate of 62.5 Hz according to a preferred embodiment of the present invention.

For example, suppose the example two bit modulator of Table I was required to have increased resolution according to the techniques of the present invention while maintaining an update rate of at least 100 Hz. A virtual five bit pulse width modulator with an update speed of 125 Hz could be created by adding additional timer states as shown in Table II. A total of 8 states are required, which for an additional timer period of 1 ms yields an 8 ms total period. The resulting minimum duty cycle is thus $1/2^5$, or 1/32. This modulation scheme is shown in FIG. 5A. However, increasing the virtual modulation to six bits equates to a minimum duty cycle of $1/2^6$ or 1/64. For the two bit modulator of Table I, and per Table II, 16 timer states are required for a total time period of 16 ms. The resulting waveform is as shown in FIG. 5B. The update rate is thus 62.5 Hz which does not meet the 100 Hz update requirements specified for the system.

Figure 6:
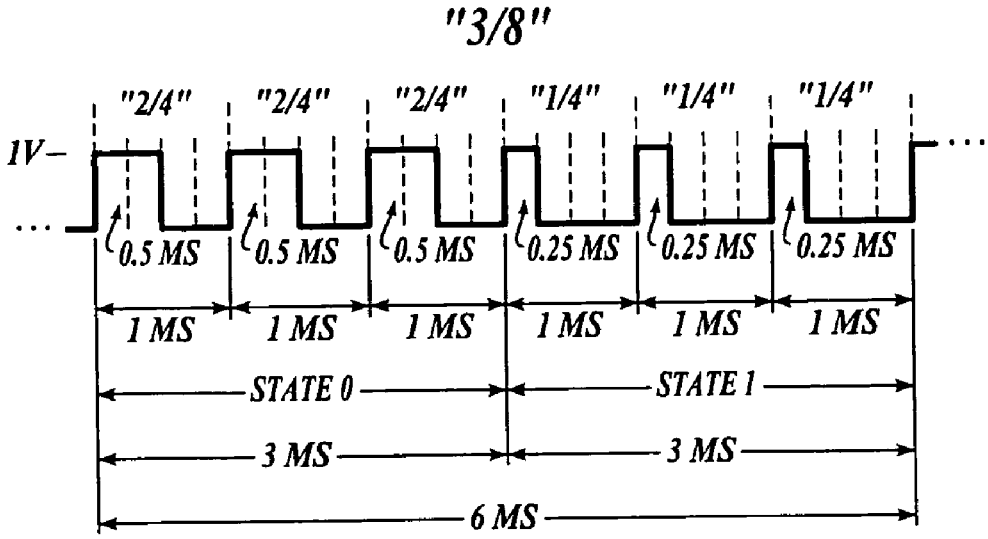
FIG. 6 is a diagram of a pulse width modulation scheme incorporating an additional timer having a duration which is an integer multiple of the pulse width modulator output according to an embodiment of the present invention.

In the example of FIGS. 2, 3A-3B and 5A-5B, the additional timer has a period equal to the normal period of the pulse width modulator. Different time periods may be used with the additional timer of the present invention. Preferably, the additional timer has a period that is an integer multiple of the nominal period of the pulse width modulator period. FIG. 6 illustrates an implementation of the present invention using the example two bit pulse width modulator of Table I with a nominal period of 1 ms and an additional timer having a period of 3 ms. The example of FIG. 6 shows an effective duty cycle of ⅜ using this technique. As seen in FIG. 6, the output of the modulator is a first value, binary 10, during the initial 3 ms period when the additional timer is in state 0. During the second 3 ms time period, the additional timer is in state 1 and the modulator output is binary 01.

Figure 7:
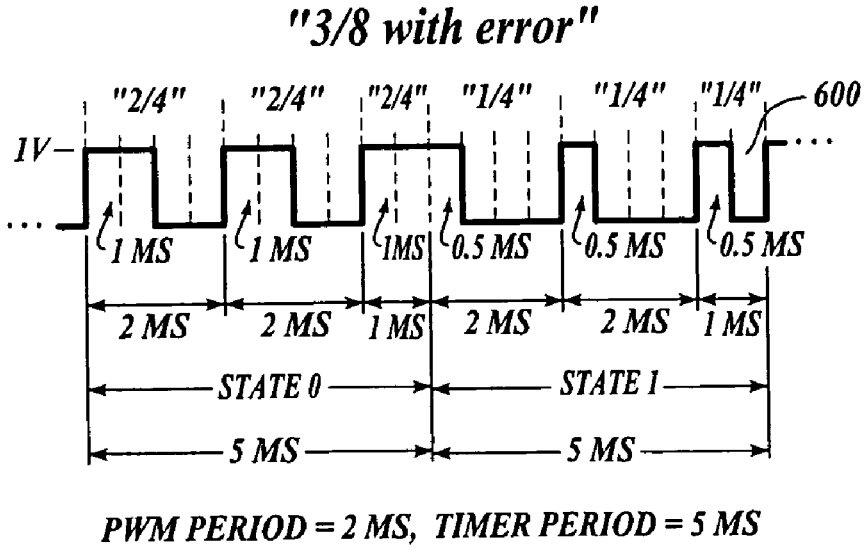
FIG. 7 is a diagram of a pulse width modulation scheme incorporating an additional timer having a duration larger than and not an integer multiple of the period of the pulse width modulator output according to an embodiment of the present invention resulting in error of the expected PWM output.

Constructing a pulse width modulator having an additional timer with a period not an integer multiple of the nominal period is possible, but may introduce nonlinearities in the modulator output. However, if the additional timer period is sufficiently larger than the period of the modulator output, these nonlinearities will be minimal. FIG. 7 diagrams such a modulation scheme for a pulse width modulator having a 2 ms nominal period and an additional timer period of 5 ms, to create a virtual 3 bit modulator. A three bit modulator can theoretically increment the duty cycle in increments of ⅛. In the diagram of FIG. 7, a ⅜ duty cycle is implemented, however, due to errors caused by the nonlinearities described above, the duty cycle is only approximately ⅜ and includes some error. Specifically during state 0, three 1 ms pulses occur. During state 1, three 0.5 ms pulse occur, but rest interval 600 shown in FIG. 7 is truncated in length and is less than the 1.5 ms rest interval associated with the remaining 0.5 ms pulses. The average duty cycle for the modulation scheme of FIG. 7 is thus:

$$\frac{1\text{ms} + 1\text{ms} + 1\text{ms} + 0.5\text{ ms} + 0.5\text{ ms} + 0.5\text{ ms}}{10\text{ ms}} = 45\%$$

A 45% duty cycle is slightly larger than the ⅜, or 37.5% duty cycle desired. The resulting error in the duty cycle is therefore:

$$\frac{0.45 - 0.375}{0.375} = 20\% \text{ relative error}$$

Figure 8:
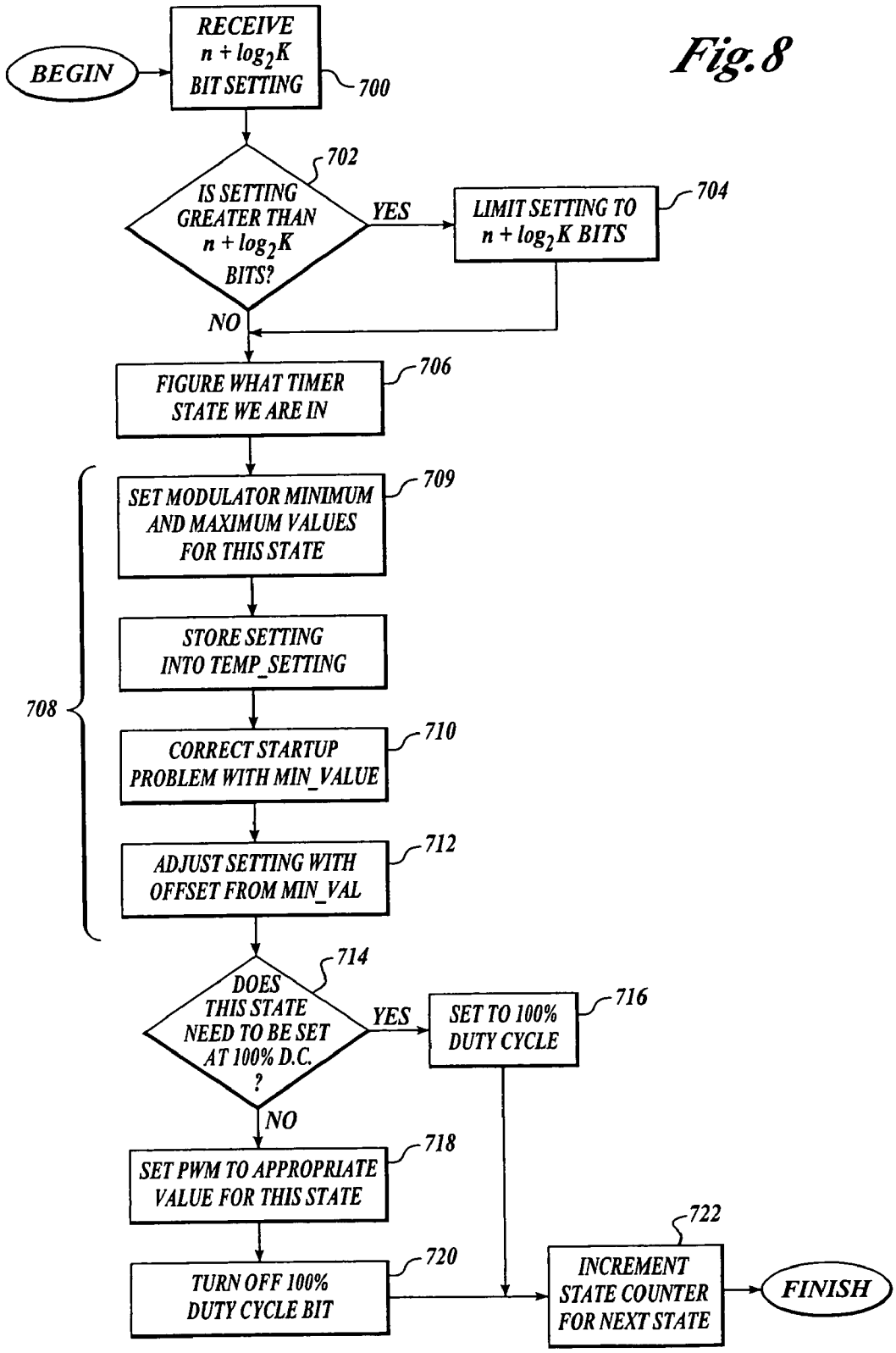
FIG. 8 is a flow chart of a method useful for implementing the present invention.

FIG. 8 contains a flow chart of a process useful for implementing the improved pulse width modulation of the present invention. In the flow chart of FIG. 8, the desired duty cycle is specified in step 700 as a word having $n=\log_2 K$ significant bits. In steps 702 and 704, the word is truncated to the maximum number permitted if the word received is in excess of this value. In step 706, the current state of the additional timer is determined. The various steps shown grouped together by braces 708 of FIG. 8 assign a modulator output value to the given timer state. In a preferred embodiment of the invention, the modulator outputs associated with each of the various states are within one of the other. Other combinations are possible, however, in a preferred embodiment of the invention, steps 710 and 712 are used to ensure that a valid modulator output is specified at start up; and in conjunction with step 709, are used to validate that the modulator output specified is within the maximum and minimum values expected for this state. Step 714 checks if a 100% duty cycle is needed for this state and if so, step 716 asserts the modulator overflow bit. Otherwise, the desired modulator output value is set in step 718 and the overflow bit deasserted in step 720. The modulator output for the current state is now established. Step 722 increments to the next state and the modulator output for that state is set by repeating the process flow of FIG. 8.

FIG. 9 shows a table of modulator output values used to create a virtual 11 bit modulator from an n=8 bit modulator using the process of FIG. 8. In FIG. 9, a modulator output is associated with each one of eight additional timer states according to the duty cycle desired.

The present invention may be implemented as firmware, in executable code, as software stored in a memory device or as a microelectronic circuit as will be readily apparent to those of ordinary skill in the art. In addition, the present invention, may be used to control the brightness of existing LCD or other LED backlit displays with greater precision without hardware redesign of the controlling pulse modulator.

Figure 10:
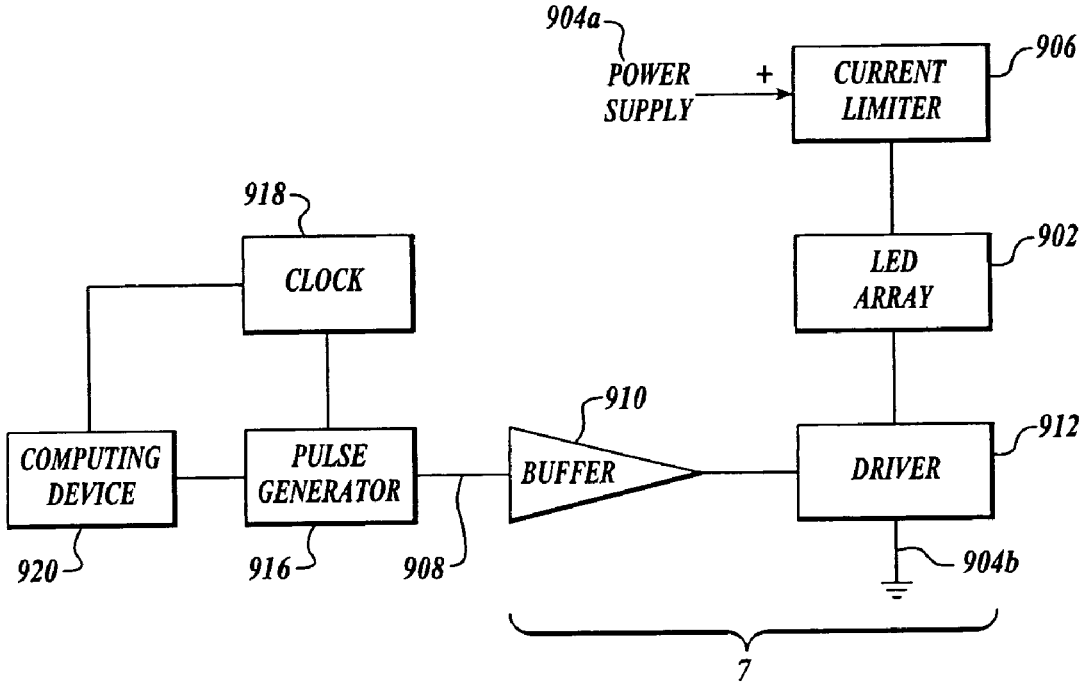
FIG. 10 is a block diagram of a pulse width modulation apparatus useful for controlling the brightness of a backlit display according to a preferred embodiment of the present invention.

FIG. 10 contains a block diagram of an LED backlight 902 and associated drive electronics. LED backlight 902 is coupled to the positive and negative poles 904*a* and 904*b* of a power supply. In a preferred embodiment of the invention, a driver 912 and buffer 910 switch on and off in response to a control pulses 908 output by a pulse width modulator 916. When driver 912 switches on, current is drawn through array 902 powering the array. The amount of time driver 912 is "on" controls the display brightness. According to one preferred embodiment of the present invention, the LED drive electronics may additionally include a current limiter 906. Current limiter 906 prevents overheating of the LEDs comprising the display by limiting the amount of current flowing through the entire array or, optionally, through the individual array strings. Current limiter 906 may comprise a plurality of resistors arranged in series with each of the individual array strings. Optionally, current limiter 906 may be as described in copending patent application Ser. No. 09/834,277, entitled: "Apparatus and Method for Controlling LED Arrays," filed on Apr. 12, 2001 and incorporated by reference; and as also described in provisional patent application Ser. No. 60/237,876, entitled: "High Precision, High Efficiency Dimming Controller for LED Arrays" also incorporated by reference.

Also according to the present invention, n bit modulator 916 is coupled to an additional timer 918 that can be used to generate $K=2^m$ states. Modulator 916 is additionally coupled to a computing device 920 which may comprise a cpu, programmable logic device or other general purpose processor, analog or digital logic circuit. Computing device 920 may additionally include memory for storing code such as, for example, that described by FIG. 8 useful for assigning a modulator output to each of the K timer states of timer 918, wherein said code is executed by computing device 920. Computing device 920 may optionally include timer 918 or be able to assert interrupts using an internal clock to thereby function as timer 918.

The invention has now been described with reference to the preferred embodiments. Variations and modifications will be readily apparent to those of ordinary skill in the art. For these reasons, the invention is to be interpreted in view of the claims.

What is claimed is:

1. A method for controlling the brightness of a display using pulse width modulation comprising the steps of:

receiving a commanded brightness level;

using an n bit pulse width modulator to assert a plurality of pulses in accordance with an output of said n bit pulse modulator wherein said modulator has a nominal time period $P_n$;

assigning a modulator output value to each one of K states of a K state timer, wherein K is greater than 2 and said timer has a timer period $P_T$;

outputting said plurality of pulses according to said modulator output value during each nominal time period $P_n$ occurring within timer period $P_T$; and supplying power to the display in accordance with said plurality of pulses.

2. The method of claim 1 wherein $P_T$ is an integer multiple of $P_n$.

3. The method of claim 1 wherein said pulse width modulator includes an overflow bit.

4. The method of claim 1 wherein $P_T=P_n$.

5. An LED backlit display comprising:

an array of LEDs;

an n bit pulse width modulator having a nominal period of $P_n$;

a timer having K states and a timer period of $P_T$;

a computing device coupled to said pulse width modulator and said timer for assigning a modulator output value to each of said K states of said timer;

whereby said pulse width modulator outputs a plurality of pulses according to said modulator output value during each nominal period occurring within said timer period $P_T$ and whereby said pulse width modulator has a resolution of $n+\log_2(K)$; and a driver coupled to said pulse width modulator for supplying power to said array in accordance with said pulse width modulator output.

6. The display of claims 5 wherein $P_T$ is an integer multiple of $P_n$.

7. The display of claim 5 wherein $P_T$ is other than an integer multiple of $P_n$ and $P_T>>P_n$.

8. The display of claim 5 wherein said modulator further comprises an overflow bit.

9. A method for controlling the brightness of a display using pulse width modulation comprising the steps of:

receiving a commanded brightness level;

using an n bit pulse width modulator to assert a plurality of pulses in accordance with an output of said n bit pulse modulator wherein said modulator has a nominal time period $P_n$;

assigning a modulator output value to each one of K states of a K state timer, wherein K is greater than 2, said timer has a timer period $P_T$, and $P_T$ is an integer multiple of $P_n$;

outputting said plurality of pulses according to said modulator output value during each nominal time period $P_n$ occurring within timer period $P_T$; and supplying power to the display in accordance with said plurality of pulses.

* * * * *